US007697860B2

(12) United States Patent
Swing et al.

(10) Patent No.: US 7,697,860 B2
(45) Date of Patent: Apr. 13, 2010

(54) FUSERS, PRINTING APPARATUSES, AND METHODS OF FUSING TONER ON MEDIA

(75) Inventors: Jeffrey N. Swing, Webster, NY (US); Eric S. Hamby, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 84 days.

(21) Appl. No.: 12/186,996

(22) Filed: Aug. 6, 2008

(65) Prior Publication Data

US 2010/0034547 A1 Feb. 11, 2010

(51) Int. Cl.
*G03G 15/20* (2006.01)

(52) U.S. Cl. ..... 399/69; 399/70

(58) Field of Classification Search ..... 399/43, 399/45, 67–70

See application file for complete search history.

(56) References Cited

U.S. PATENT DOCUMENTS

| | | | | |
|---|---|---|---|---|
| 4,719,489 | A * | 1/1988 | Ohkubo et al. | 399/45 |
| 6,411,785 | B1 * | 6/2002 | Ogawahara et al. | 399/69 |
| 6,505,832 | B2 | 1/2003 | Moore et al. | |
| 6,799,004 | B2 * | 9/2004 | Richtsmeier | 399/70 |
| 7,057,141 | B1 | 6/2006 | Moy | |

* cited by examiner

*Primary Examiner*—Hoang Ngo
(74) *Attorney, Agent, or Firm*—Edward A. Brown; Prass LLP

(57) ABSTRACT

Fusers for fusing toner on media, printing apparatuses, and methods of fusing toner on media in printing apparatuses are disclosed. An exemplary embodiment of the fusers comprises a fuser roll comprising a fusing imaging surface; at least one heating element for heating the fuser roll; a pressure roll including an outer surface, the outer surface and the fusing imaging surface defining a nip; a temperature sensor for sensing a temperature on the fusing imaging surface; a time delay calculator connected to the temperature sensor; a feedback controller connected to the temperature sensor and the heating element, the feedback controller receives a signal from the temperature sensor indicating the temperature on the fusing imaging surface and controls the heating element based on the temperature; and an open-loop controller connected to the heating element and the time delay calculator. The open-loop controller receives a time delay signal from the time delay calculator and bypasses the feedback controller to control the heating element to increase the temperature of the fusing imaging surface starting at about a time, t−Δt (where Δt is a time delay), which is before a medium arrives at the nip, and continuing until about a time, t, at which the medium arrives at the nip and is contacted by the fusing imaging surface. The feedback controller resumes control of the heating element at about the time t.

20 Claims, 4 Drawing Sheets

FUSERS, PRINTING APPARATUSES, AND METHODS OF FUSING TONER ON MEDIA

BACKGROUND

Fusers, printing apparatuses, and methods of fusing toner on media in printing processes are disclosed.

In a typical xerographic printing process, toner images are formed on media, and then the toner is heated to fuse the toner on the media. One process used for thermal fusing toner onto media uses a fuser including a nip. During operation, a medium with a toner image is fed to the nip, where heat and pressure are applied to the medium to fuse the toner.

It would be desirable to provide fusers that can heat media more consistently during fusing to provide consistent images.

SUMMARY

According to aspects of the embodiments, fusers, printing apparatuses, and methods of fusing toner on media in printing apparatuses are provided. An exemplary embodiment of the fusers comprises a fuser roll comprising a fusing imaging surface; at least one heating element for heating the fuser roll; a pressure roll including an outer surface, the outer surface and the fusing imaging surface defining a nip; a temperature sensor for sensing a temperature on the fusing imaging surface; a time delay calculator connected to the temperature sensor; a feedback controller connected to the temperature sensor and the heating element, the feedback controller receives a signal from the temperature sensor indicating the temperature on the fusing imaging surface and controls the heating element based on the temperature; and an open-loop controller connected to the heating element and the time delay calculator. The open-loop controller receives a time delay signal from the time delay calculator and bypasses the feedback controller to control the heating element to increase the temperature of the fusing imaging surface starting at about a time, t−Δt (where Δt is a time delay), which is before a medium arrives at the nip, and continuing until about a time, t, at which the medium arrives at the nip and is contacted by the fusing imaging surface, and the feedback controller resumes control of the heating element at about the time t.

DRAWINGS

DETAILED DESCRIPTION

Figure 1:
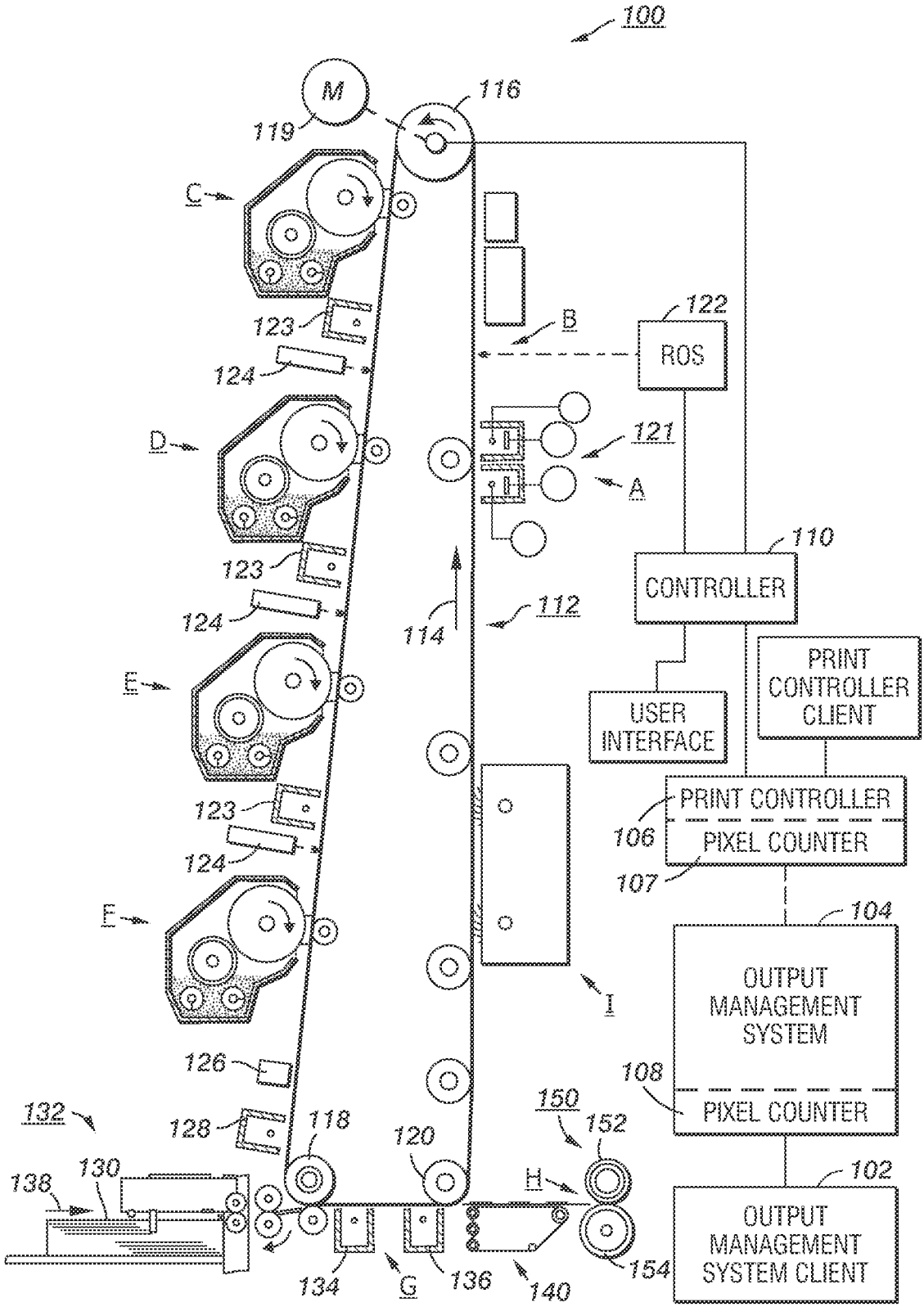
FIG. 1 illustrates an exemplary embodiment of a printing apparatus.

The disclosed embodiments include a fuser comprising a fuser roll comprising a fusing imaging surface and at least one heating element for heating the fuser roll; a pressure roll including an outer surface, the outer surface and the fusing imaging surface defining a nip; a temperature sensor for sensing a temperature on the fusing imaging surface; a time delay calculator connected to the temperature sensor; a feedback controller connected to the temperature sensor and the heating element, the feedback controller receives a signal from the temperature sensor indicating the temperature on the fusing imaging surface and controls the heating element based on the temperature; and an open-loop controller connected to the heating element and the time delay calculator. The open-loop controller receives a time delay signal from the time delay calculator and bypasses the feedback controller to control the heating element to increase the temperature of the fusing imaging surface starting at about a time, t−Δt (where Δt is a time delay), which is before a medium arrives at the nip, and continuing until about a time, t, at which the medium arrives at the nip and is contacted by the fusing imaging surface. The feedback controller resumes control of the heating element at about the time t.

The disclosed embodiments further include a fuser comprising a fuser belt having a fusing imaging surface; a first heating element for heating the fuser belt; a temperature sensor for sensing a temperature on the fusing imaging surface; a pressure roll including an outer surface, the outer surface and the fusing imaging surface defining a nip; a time delay calculator connected to the temperature sensor; a feedback controller connected to the temperature sensor and the first heating element, the feedback controller receives a signal from the temperature sensor indicating the temperature on the fusing imaging surface and controls the first heating element based on the temperature; and an open-loop controller connected to the first heating element and the time delay calculator. The open-loop controller receives a time delay signal from the time delay calculator and bypasses the feedback controller to control the first heating element to increase the temperature of the fusing imaging surface starting at about a time, t−Δt (where Δt is a time delay), which is before a medium arrives at the nip, and continuing until about a time, t, at which the medium arrives at the nip and is contacted by the fusing imaging surface. The feedback controller resumes control of the first heating element at about the time t.

The disclosed embodiments further include a method of fusing toner on a medium in a fuser comprising a fusing member including a fusing imaging surface, at least a first heating element for heating the fusing imaging surface, a feedback controller and an open-loop controller connected to the first heating element, a time delay calculator connected to the feedback controller, a pressure roll including an outer surface, and a nip defined between the fusing imaging surface and the outer surface. The method comprises sensing a temperature on the fusing imaging surface; controlling the first heating element with the feedback controller based on the temperature on the fusing imaging surface; feeding a first medium having toner thereon toward the nip; sending a time delay signal from the time delay calculator to the bypass controller to bypass the feedback controller using the open-loop controller to control the first heating element to increase the temperature of the fusing imaging surface starting at about a time, t1−Δt1, which is before the first medium arrives at the nip, and continuing until about a time, t1, at which the first medium arrives at the nip and is contacted by the fusing imaging surface; and resuming control of the first heating element by the feedback controller at about the time t1.

FIG. 1 illustrates an exemplary embodiment of a printing apparatus in which embodiments of the disclosed fusers can be used. Such printing apparatuses are disclosed in U.S. Pat. No. 6,505,832, which is hereby incorporated by reference in its entirety. The printing apparatus is used to produce images on media using a photoreceptor belt. It will be understood, however, that embodiments of the fusers can be used in other imaging systems. Such systems include, e.g., multiple-pass color process systems, single or multiple pass highlight color systems, or black and white printing systems.

As shown in FIG. 1, printing jobs are sent from an output management system client 102 to an output management system 104. The output management system 104 supplies printing jobs to a print controller 106. A pixel counter 108 in the output management system 104 counts the number of pixels to be imaged with toner on each sheet or page of the print job, for each color. The pixel count information is stored in the memory of the output management system 104. Job control information is communicated from the print controller 106 to a controller 110.

The printing apparatus 100 includes a continuous (endless) photoreceptor belt 112 supported on a drive roll 116 and rolls 118, 120. The drive roll 116 is connected to a drive motor 119. The drive motor 119 moves the photoreceptor belt 112 in the direction of arrow 114 through the imaging stations A to I shown in FIG. 1.

During the printing process, the photoreceptor belt 112 passes through a charging station A. This station includes a corona generating device 121 for charging the photoconductive surface of the photoreceptor belt 112.

Next, the charged portion of the photoconductive surface of the photoreceptor belt 112 is advanced through an imaging/exposure station B. At this station, the controller 110 receives image signals from the print controller 106 representing the desired output image, and converts these signals to signals transmitted to a laser raster output scanner (ROS) 122. The photoreceptor belt 112 undergoes dark decay. When exposed at the exposure station B, the photoreceptor belt 112 is discharged, resulting in the photoreceptor belt 112 containing charged areas and discharged or developed areas.

At a first development station C, charged toner particles, e.g., black particles, are attracted to the electrostatic latent image on the photoreceptor belt 112. The developed image is conveyed past a charging device 123 at which the photoreceptor belt 112 and developed toner image areas are recharged to a predetermined level.

A second exposure/imaging is performed by device 124. The device selectively discharges the photoreceptor belt 112 on toned areas and/or bare areas, based on the image to be developed with the second color toner. At this point of the process, the photoreceptor belt 112 contains areas with toner and areas without toner at relatively high voltage levels, as well as at relatively low voltage levels. These low voltage areas represent image areas. At a second developer station D, a negatively-charged developer material comprising, e.g., yellow toner, is transferred to latent images on the photoreceptor belt 112 using a second developer system.

The above procedure is repeated for a third image for, e.g., magenta toner, at station E, using a third developer system, and for a fourth image and color toner, e.g., cyan toner, at station F, using a fourth developer system. This procedure develops a full-color composite toner image on the photoreceptor belt 112. A mass sensor 126 measures the developed mass per unit area.

In cases where some toner charge is totally neutralized, or the polarity reversed, a negative pre-transfer dicorotron member 128 can condition the toner for transfer to a medium using positive corona discharge.

In the process, a medium 130 (e.g., paper) is advanced to a transfer station G by a feeding apparatus 132. The medium 130 is brought into contact with the photoreceptor belt 112 in a timed sequence so that the toner powder image developed on the photoreceptor belt 112 contacts the advancing medium 130.

The transfer station G includes a transfer dicorotron 134 for spraying positive ions onto the backside of the medium 130. The ions attract the negatively-charged toner powder images from the photoreceptor belt 112 to the medium 130. A detack dicorotron 136 facilitates stripping of media from the photoreceptor belt 130.

After the toner image has been transferred, the medium continues to advance, in the direction of arrow 138, onto a conveyor 140. The conveyor 140 advances the medium to a fusing station H. The fusing station H includes a fuser 150 for permanently affixing, i.e., fusing, the transferred powder image to the medium 130. The fuser 150 includes a heated fuser roll 152 and a pressure roll 154. The medium 130 is advanced between the fuser roll 152 and pressure roll 154 with the toner powder image contacting a fusing imaging surface of the fuser roll 152 to permanently affix the toner powder images to the medium 130. The medium 130 is then guided to an output device (not shown) for subsequent removal from the apparatus by the operator.

After the medium 130 has been separated from the photoreceptor belt 112, residual toner particles on non-image areas on the photoconductive surface of the photoreceptor belt 112 are removed from the photoconductive surface at a cleaning station I.

Figure 2:
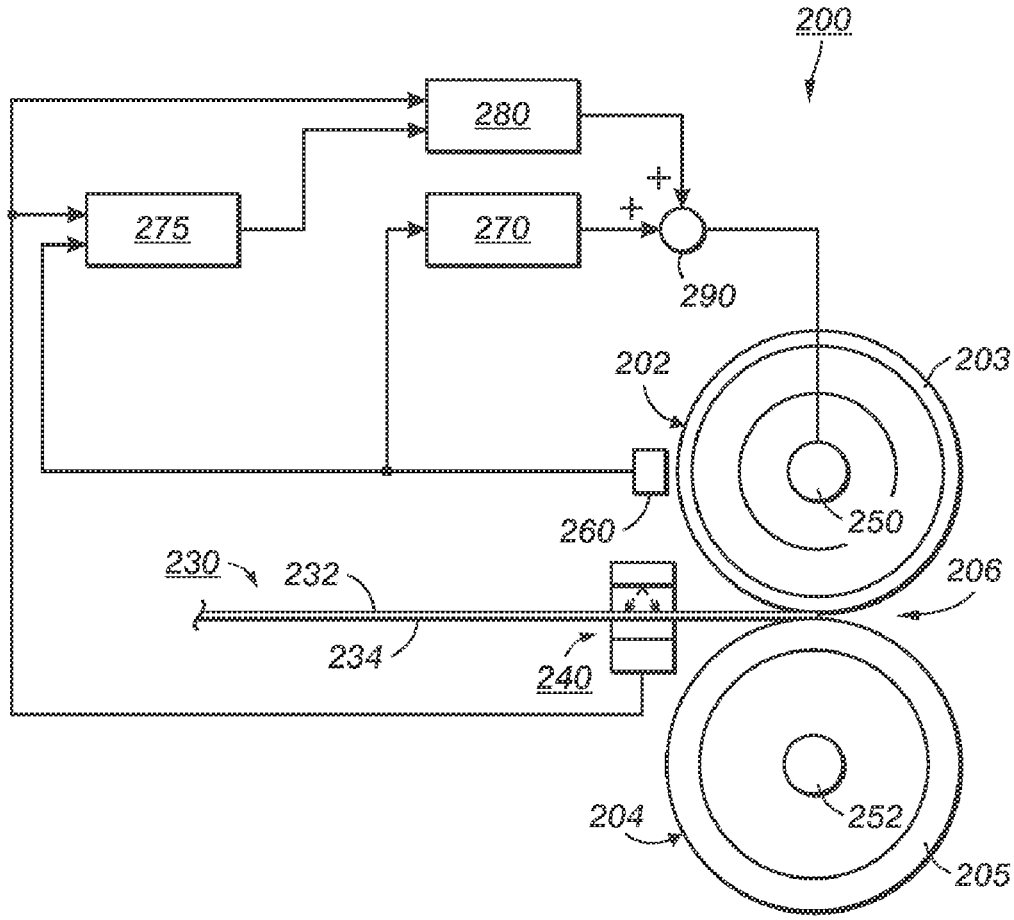
FIG. 2 illustrates an exemplary embodiment of a fuser including a fuser roll.

FIG. 2 illustrates an exemplary embodiment of a fuser 200. Embodiments of the fuser 200 can be used in printing apparatuses that have various constructions for fusing toner images on media. For example, the fuser 200 can be used in the printing apparatus 100 shown in FIG. 1, in place of the fuser 150.

The fuser 200 shown in FIG. 2 includes a fusing member in the form of a fuser roll 202, a pressure roll 204, and a nip 206 between the fuser roll 202 and pressure roll 204. In embodiments, the fuser roll 202 is rotated counter-clockwise by a drive mechanism, and the pressure roll 202 is rotated clockwise. As disclosed herein, other embodiments of the fuser can include a fuser belt.

In embodiments, the fuser roll 202 is internally heated by a heating element 250 located inside of the fuser roll. In embodiments, the heating element 250 is a lamp, e.g., a tungsten quartz lamp. The heating element 250 extends axially along the length dimension of the fuser roll 202. The heating element 250 is powered by a power supply to heat the outer surface 203 (fusing imaging surface) of the fuser roll 202.

In embodiments, the pressure roll 204 is internally heated by a heating element 252, as shown. The heating element 252 is powered by a power supply to heat the outer surface 205 of the pressure roll 204.

The fuser 200 includes a temperature sensor 260 positioned to sense the temperature at a selected location on the outer surface 203 of the fuser roll 202. In other embodiments, two or more axially-spaced temperature sensors can be used in the fuser 200 to sense the temperature of the outer surface 203 at two or more locations.

In embodiments, a feedback controller 270 is connected to the heating element 250 of the fuser roll 202 and also to the temperature sensor 260. The feedback controller 270 can be, e.g., a proportional-integral-derivative (PID) controller. The feedback controller 270 corrects errors between the current temperature measured on the outer surface 203 of the fuser roll 202 by the temperature sensor 260, and the set-point value of this temperature, by feedback (or closed-loop) control. The feedback controller 270 maintains the idle temperature of the fuser roll 202 when the printing apparatus is in the idle state between print jobs. The feedback controller 270 also maintains the fuser roll 202 at the temperature set point when the printing apparatus is in the run state. In embodiments, the idle temperature can be lower than, equal to, or higher than the fusing temperature for media to be printed in the fuser 200.

When the fuser 200 is idling, the power level applied to maintain the temperature of the fuser roll 202 at the idle temperature is low, e.g., about 5% to about 10% of the maximum rated power of the heating element 250.

FIG. 2 shows a medium 230, e.g., plain or coated paper, a transparency, or other type of print medium that has been fed to the nip 206. The medium 230 is fed to the nip 206 by a sheet feeding device of the printing apparatus. The medium 230 has a top surface 232 and a bottom surface 234. At least one toner image (text and/or other type(s) of image) is carried on the top surface 232. At the nip 206, the outer surface 203 of the rotating fuser roll 202 contacts the top surface 232 of the medium 230, and the outer surface 205 of the rotating pressure roll 204 contacts the bottom surface 234 of the medium 230. The pressure roll 204 and fuser belt 220 apply sufficient heat and pressure to the medium 230 to fuse the toner image(s) on the top surface 232.

The fusing temperature used for fusing toner on the medium 230 is based on characteristics of the medium 230, including its thickness (weight), and whether the medium 230 is coated or uncoated (plain). Typically, paper media weights can be classified as follows: lightweight media: ≦about 75 gsm, midweight media: about 75 gsm to about 160 gsm, and heavyweight media: ≧160 gsm. Typically, these types of media have the following fusing temperatures: lightweight media: about 180° C., midweight media: about 190° C., and heavyweight media: about 200° C. For a given media weight, coated media may have a fusing temperature 10° C. higher than uncoated media. Transparencies typically have a fusing temperature of about 200° C. The fusing temperature for media can also depend on the toner composition.

Feeding the medium 230 through the nip 206 between the fuser roll 202 and pressure roll 204 (or between a pressure roll and a fuser belt defining a nip of a fuser) can use significantly more power than is used for maintaining the fuser roll 202 (or fuser belt) in the idle state. Typically, about 60% to about 90% of the maximum rated power of the heating element 250 of the fuser roll 202 (or of a roll supporting a fuser belt) is used when feeding media through the nip 206. The increased thermal load resulting from the medium 230 arriving at the nip 206 and contacting the fuser roll 202 causes the temperature of the fuser roll 202 to drop, such as to below the temperature set-point used for the fusing toner on the medium. For example, the fuser roll 202 can drop to a temperature about 10° C. to about 20° C. below the temperature set-point.

The magnitude of the temperature drop of the fuser roll 202 (or fuser belt) when the medium 230 arrives at the nip 206 is partially dependent on the media type. Less thermal energy needs to be supplied to thinner media than to thicker media to fuse toner on the media. For a given combination of media composition and toner composition, less thermal energy needs to be supplied to lightweight media than to mid-weight media, and to mid-weight media than to heavyweight media, in order to fuse the toner. Furthermore, for the same media weight and toner composition, toner can be fused on uncoated media using less thermal energy than for coated media of the same weight.

The magnitude of the temperature drop of the fuser roll 202 when the medium 230 arrives at the nip 206 additionally depends on the hardware configuration of the fuser roll 202. Parameters that can affect the thermal response of the fuser roll 202 include, e.g., whether the printing apparatus including the fuser 200 is being operated under power limiting conditions for the heating element 250. Such power limiting conditions can include, e.g., using a reduced AC line voltage, or flicker/harmonics limiting devices or countermeasures.

Characteristics of the fuser roll 202 can also affect the magnitude of the temperature drop of the fuser roll 202. For example, decreasing the power rating of the heating element 250 can increase the temperature drop. The thermal properties (e.g., thermal mass and thermal conductivity) of the materials forming the conforming, outer layers of the fuser roll 202 can also affect the temperature drop, by affecting heat transfer to the outer surface 203 of the fuser roll 202.

In some situations, it may be possible to mitigate the temperature drop of the fuser roll 202 caused by contact with the medium 230 by using a higher temperature set point for the fuser roll 202 when in the idle state of the fuser 200. Although this approach allows a larger temperature drop of the fuser roll 202 before fused image quality may be degraded due, e.g., to poor adherence of toner to media, the temperature of the fuser roll 202 can still drop significantly when heavyweight and/or coated media arrive at the nip 206 due to the high thermal load imposed on the fuser roll 202. The use of power limiting conditions for the fuser 200 also increases the magnitude of the temperature drop of the fuser roll 202.

When the heating element 250 is being controlled by the feedback controller 270, the temperature of the fuser roll 202 will drop to below the set-point before the heating element 250 is powered to re-heat the fuser roll 202. In order to re-heat the fuser roll 202 back to the temperature set-point, the heating element 250 needs to produce an increased thermal output. However, the feedback controller 270 takes time to control the heating element 250 by feedback control to raise the temperature of the fuser roll 202 back up to the set-point. For example, it can take about 30 seconds to about 45 seconds to re-establish the set-point. Power-limiting conditions increase the amount of time needed for the heating element 250 to reach full power and image quality. During this time period, the temperature of the fuser roll 202 will continue to drop and subsequent sheets that arrive at the nip 206 will be heated at a temperature below the set-point temperature. Consequently, these sheets can have unacceptable toner image quality.

In embodiments, the fuser 200 includes features to address this media heating problem. As shown, the fuser 200 includes an open-loop controller 280 connected to the heating element 250 of the fuser roll 202. Input signals from the feedback controller 270 and open-loop controller 280 are added at a summing junction 290 connected to the heating element 250 (and to a power supply for the heating element 250) to produce a single output signal.

The arrival time, t, of the medium 230 at the nip 206 can be accurately estimated or calculated based on the media feeding characteristics of the printing apparatus, or sensed by a sensor. The medium 230 can be the first print in a print job when the printing apparatus is transitioning from the idle state to the run state. Starting at about a selected time, $t-\Delta t$, which is prior to the medium 230 arriving at the nip 206, and continuing for the duration of the time period, $\Delta t$, until about the time, t, at which the medium 230 arrives at the nip, the feedback controller 270 is bypassed by the open-loop controller 280. This bypass is initiated by an algorithm. The algorithm causes the feedback control by the feedback controller 270 to be disabled for the time period $\Delta t$. The time period, $\Delta t$, is referred to herein as the "time delay." During the time delay, the medium that will be arriving at the nip 206 is located either in a feeding tray of the printing apparatus, or moving through the media feed path toward the nip 206.

In embodiments, the length of the time delay is based on the media type and the hardware configuration of the fuser 200. Media can be categorized based, e.g., on thickness, composition, smoothness and/or being coated or uncoated. For uncoated media, the time delay can typically be about 5 seconds to about 15 seconds, for different media weights. For coated media, the time delay can typically be several seconds longer for each media weight.

The hardware configuration of the fuser 200 and the use of power-limiting conditions can have the following effects on the time delay, Δt: increasing the power rating of the heating element 250 decreases the time delay, Δt, increasing the thermal conductivity of the fuser roll 202 decreases Δt, increasing the thermal mass of the fuser roll 202 increases Δt, increasing the line voltage decreases Δt, and using current-limiting devices increases Δt. These effects are considered in the time delay calculations.

As shown, in embodiments, the fuser 200 includes a time delay calculator 275 connected to the temperature sensor 260 and the open-loop controller 280. In embodiments, the time delay calculator 275 includes an algorithm for calculating time delays used for fusing toner on media having different characteristics. In embodiments, an initial time delay is used by the open-loop controller 280 for an initial medium of a print job. In embodiments, temperature information from the temperature sensor 260 is not used by the open-loop controller. The time delay calculator 275 is used to re-calculate the time delay value using temperature performance information derived from the temperature sensor 260 for subsequently-printed media in the print job. In embodiments, the time delay calculator 275 can be provided on software stored on a computer-readable medium, which is encoded with a data structure readable by a system computer to perform the algorithm; on hardware, such as a fuser controller board; or provided on another suitable storage device. Initial and re-calculated time delay values can be stored in machine non-volatile memory (NVM), for example. The time delay calculator 275 sends a time delay signal to the open-loop controller 280 to indicate when the heating element 250 in the fuser roll 202 is to be powered to a high power level. The closed-loop feedback controller 270 and the open-loop controller 280 can be provided, e.g., in software encoded on computer readable media, or on firmware in the fuser controller board.

During the bypass time period (i.e., time delay), the open-loop controller 280 controls the heating element 250 to increase the amount of power supplied to heat the fuser roll 202 to a selected high power level. The feeding of the medium 230 to the nip 206 and the control of the heating element 250 are timed such that the medium 230 arrives at the nip 206 at time, t, at which the feedback controller 270 then resumes control of the heating element 250. In embodiments, the fuser 200 includes a media sensor 240, such as optical sensor or the like, located upstream of the nip 206 to sense the arrival of the medium 230 at the nip 206. The sensor 240 is connected to the time delay calculator 275 and the open-loop controller 280. The time delay calculator 275 measures temperature performance of the fuser roll 202 based on signals received from the temperature sensor 260. By sensing the arrival time, t, of the medium 230 at the nip 206 using the sensor 240, and calculating the time delay, Δt, using the time delay calculator 275, the time, t−Δt, at which open-loop control is started can be calculated. The open-loop controller 280 uses the media timing signal from the sensor 240 and the time delay signal from the time delay calculator 275 to increase the power output of the heating element 250 from a low-power, idle state level to a high-power, run state level before the medium 230 arrives at the nip 206. Consequently, temperature droop of the fuser roll 202 that occurs when the medium 230 contacts the fuser roll 202 can be mitigated to produce high image quality in the first few media of a print job, as well as in the subsequent media of the print job.

Figure 3:
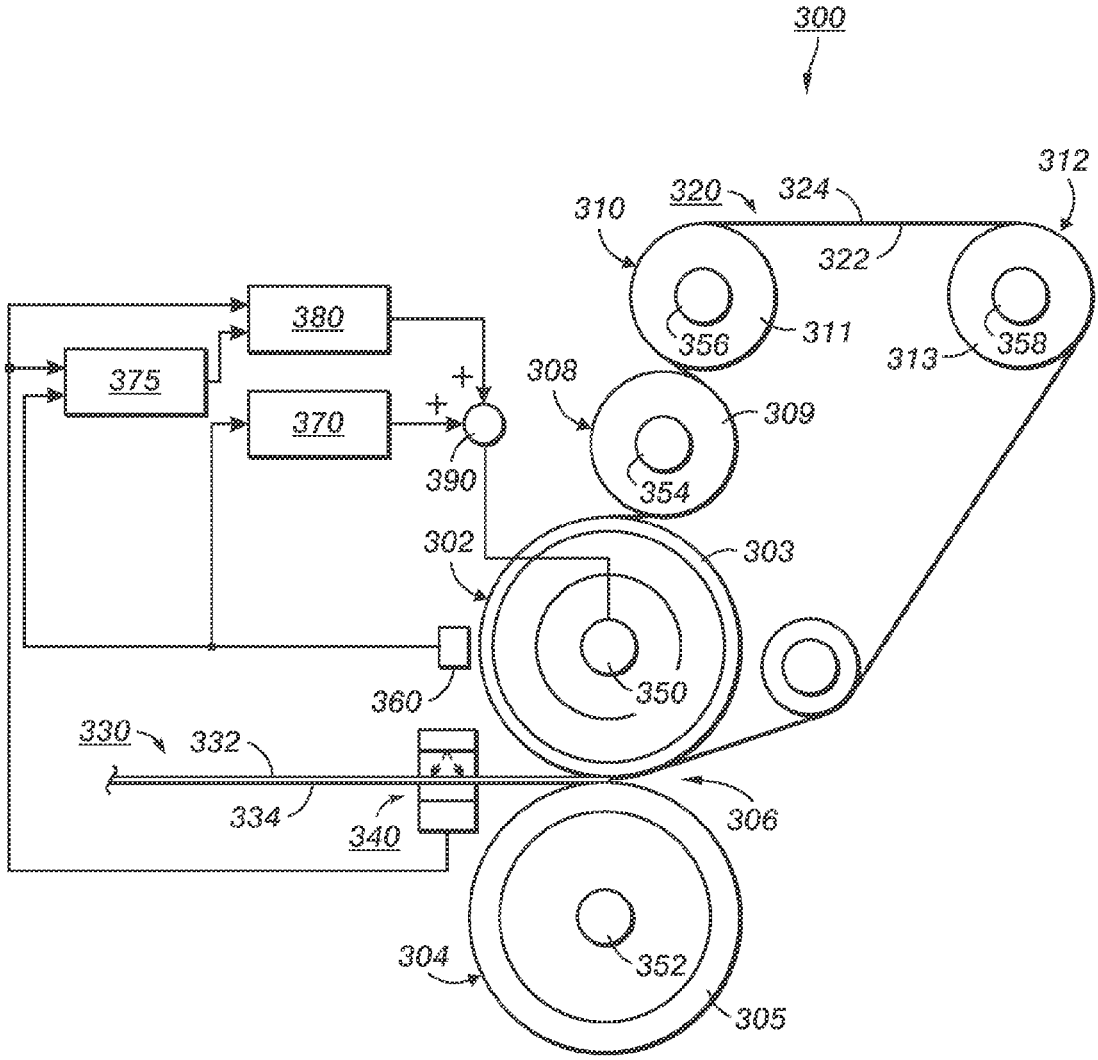
FIG. 3 illustrates an exemplary embodiment of a fuser including a fuser belt.

FIG. 3 depicts a fuser 300 according to another exemplary embodiment. As shown, the fuser 300 includes a fuser roll 302, pressure roll 304 and a nip 306 between the fuser roll 302 and pressure roll 304. The fuser 300 also includes idler rolls 308, 310, 312 and 314. In other embodiments, the fuser can include a different number of such idler rolls. The fuser roll 302 can rotate counter-clockwise while the pressure roll 304 rotates clockwise. A fusing member in the form of an endless (continuous) fuser belt 320 is supported on the fuser roll 302 and the idler rolls 308, 310, 312 and 314. In embodiments, the fuser belt 320 is rotated counter-clockwise by a drive mechanism, and the pressure roll 304 is rotated clockwise.

Embodiments of the fuser belt 320 have a multi-layer construction, and can include, e.g., a base layer, an intermediate layer on the base layer, and an outer layer on the intermediate layer. The base layer forms the inner surface 322 of the fuser belt 320, which contacts the rolls supporting the fuser belt, while the outer layer forms the outer surface 324 (fusing imaging surface), which contacts media. In an exemplary embodiment, the inner layer is composed of polyimide, or the like; the intermediate layer is composed of silicone, or the like; and the outer layer is composed of a fluoroelastomer sold under the trademark Viton® by DuPont Performance Elastomers, L.L.C., or the like. In the embodiment, the polyimide layer forms the inner surface 322, and the fluoroelastomer layer forms the outer surface 324, of the fuser belt 320. Typically, the base layer has a thickness of about 50 μm to about 100 μm, the intermediate layer has a thickness of about 200 μm to about 400 μm, and the outer layer has a thickness of about 20 μm to about 40 μm. The fuser belt 320 typically has a width of about 350 mm to about 450 mm.

In embodiments of the fuser 300, the fuser belt 320 can have a length of at least about 500 mm, about 600 mm, about 700 mm, about 800 mm, about 900 mm, about 1000 mm, or even longer. By using such longer fuser belts in embodiments of the fuser 300, the fuser belt 320 can provide a larger surface area for wear and, consequently, a longer service life, than shorter belts.

As shown, the fuser roll 302 and the idler rolls 308, 310 and 312 are internally heated by one or more heating elements 350, 354, 356 and 358, respectively, located inside of these rolls. In embodiments, the heating elements 350 can be lamps, such as tungsten quartz lamps. The heating elements 350 extend axially along the fuser roll 302 and idler rolls 308, 310, 312. The heating elements are powered by at least one power supply to supply heat from the outer surface 303 of the fuser roll 302, the outer surface 309 of the idler roll 308, the outer surface 311 of the idler roll 310, and the outer surface 313 of the idler roll 312, to the fuser belt 320.

The fuser 300 further includes a temperature sensor 360 for sensing temperature on the outer surface 324 of the fuser belt 320 close to the nip 306. In embodiments, at least two axially-spaced temperature sensors can be positioned to sense the temperature profile of the outer surface 324 at two or more locations. The temperature sensor 360 is connected to a time delay calculator 375.

In embodiments, a feedback controller 370 is connected to the temperature sensor 360, the heating element 350 of the fuser roll 302, and the heating elements 354, 356 and 358 of the idler rolls 308, 310 and 312, respectively. The feedback controller 370 can be, e.g., a PID controller. The feedback controller 370 corrects errors between the temperature measured on the outer surface 324 of the fuser belt 320 by the temperature sensor 360, and the temperature set-point value for the fuser. The feedback controller 370 controls the heating elements 350, 354, 356 and 358 to maintain the fuser belt 320 at the idle temperature when the printing apparatus is in the idle state between print jobs. The feedback controller 370 also maintains the fuser belt 320 at the temperature set point when in the run state.

In embodiments, the fuser 300 further includes an open-loop controller 380 connected to the heating element 350 of the fuser roll 302; the heating elements 354, 356 and 358 of the idler rolls 308, 310 and 312, respectively; and the time delay calculator 375. As shown, input signals from the feedback controller 370 and the open-loop controller 380 are added at a summing junction 390. Output signals are sent from the summing junction 390 to the heating elements 350, 354, 356 and 358.

FIG. 3 shows a medium 330, e.g., plain or uncoated paper, a transparency, or other type of print medium, arriving at the nip 306. The medium 330 is fed by a sheet feeding device of the printing apparatus. The medium 330 has a top surface 332 and a bottom surface 334. At least one toner image is carried on the top surface 332. At the nip 306, the outer surface 324 of the heated fuser belt 320 contacts the top surface 332 of the medium 330, and the outer surface 305 of the pressure roll 304 contacts the bottom surface 334 of the medium 330, to fuse the toner image on the medium 330.

The arrival time, t, of the medium 330 at the nip 306 is estimated or calculated based on the media feeding characteristics of the printing apparatus, or sensed by a sensor. In the embodiment, the fuser 300 includes a sensor 340, such as an optical sensor or the like, located upstream of the nip 306 to sense the arrival of the medium 330 at the nip 306. The sensor 340 is connected to the time delay calculator 375 and the open-loop controller 380. The time delay calculator 375 calculates time delays (i.e., values of Δt) based on temperature performance of the fuser belt 320 using signals from the temperature sensor 360, allowing initial time delay values used for media to be re-calculated and updated. Time delay signals are transmitted from the time delay calculator 375 to the open-loop controller 380. Signals are sent from the media sensor 340 to the time delay calculator 375 and open-loop controller 380. The arrival time of the medium 330 is determined, allowing the time, t−Δt, at which open-loop control is to be started to be determined. The medium 330 can be the first print in the print job.

Starting at time, t−Δt, which is before the medium 330 arrives at the nip 306, and continuing for the time period, Δt, until the time, t, at which the medium 330 arrives at the nip, the feedback controller 370 is bypassed by the open-loop controller 380. During this bypass time period, the open-loop controller 380 controls the heating elements 350, 354, 356 and 358 to increase the supply of power to heat the fuser belt 320. The heating elements 350, 354, 356 and 358 can be operated up to their full-power levels during the bypass time period. The heating elements 350, 354, 356 and 358 can operate at different power levels during the bypass time period. The feeding of the medium 330 to the nip 306 and the control of the heating elements 350, 354, 356 and 358 are timed such that the medium 330 arrives at the nip 306 at the time, t, at which the feedback controller 370 resumes control of the heating elements 350, 354, 356 and 358. Open-loop control is used to increase the power output of the heating elements 350, 354, 356 and 358 from a low-power, idle state level to a high-power, run state level before the medium 330 arrives at the nip 306. Consequently, temperature droop of the fuser belt 320 that occurs when the medium 330 contacts the fuser belt 320 can be mitigated to produce high image quality in the first few media of a print job, and in the subsequent media of the print job.

Figure 4:
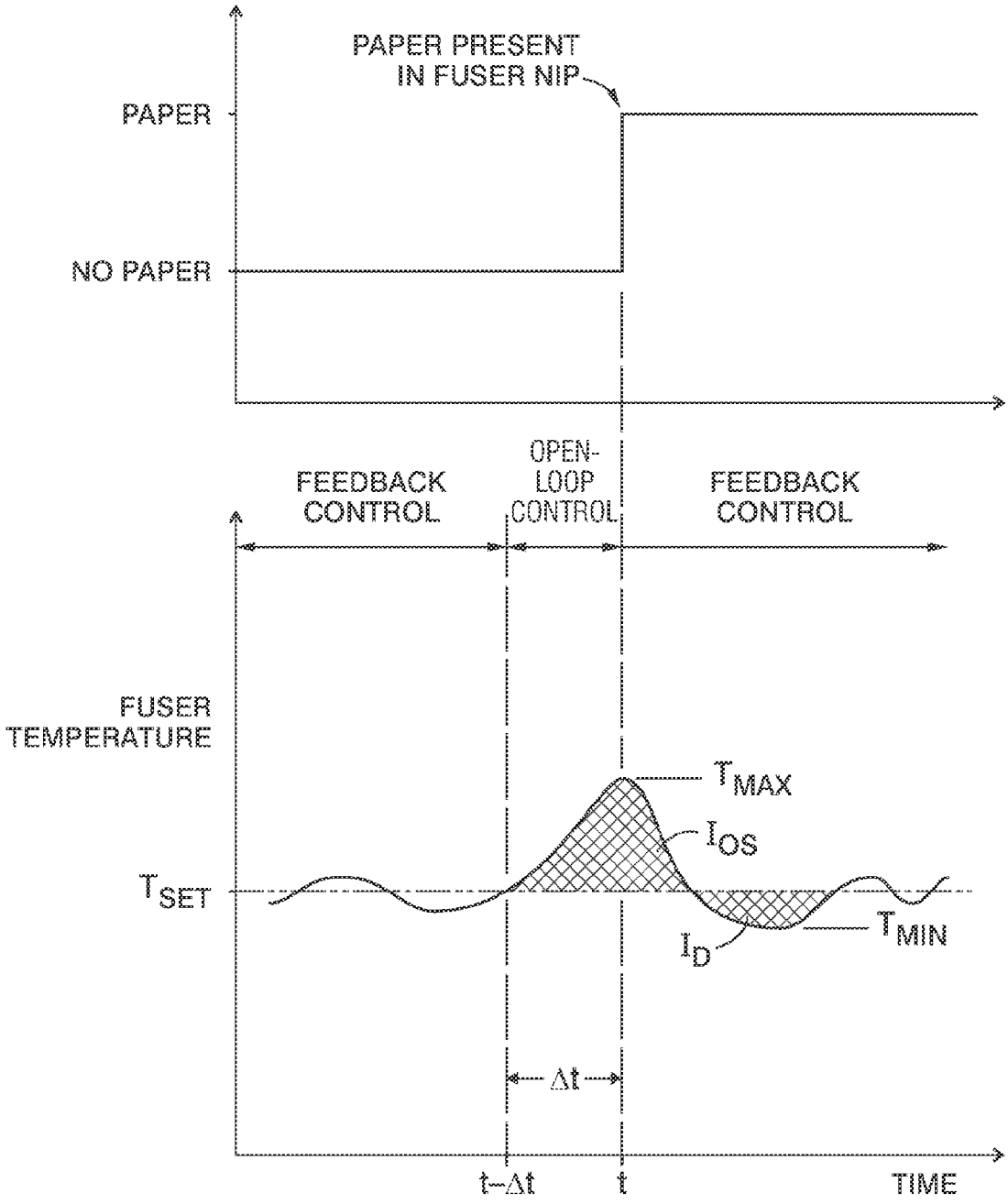
FIG. 4 shows an exemplary fuser temperature versus time curve.

FIG. 4 depicts an exemplary embodiment of controlling at least one heating element of a fuser prior to, and after, arrival of a medium at the fuser nip. For example, the fuser 200 and the fuser 300 can be controlled. As shown, the heating element is under feedback control up until the time, t−Δt. At this time, the feedback control is bypassed by sending time delay signals from a time delay calculator and media timing signals from a media sensor to an open-loop controller, and open-loop control of the heating element is started. The open-loop control is continued for the time period, Δt. At time, t, feedback control of the heating element is resumed.

As shown in FIG. 4, in the embodiment, a medium, i.e., paper, arrives at the fuser nip at the time, t. At this time, the feedback controller resumes control. The fuser temperature is maintained at about the temperature set-point, $T_{SET}$, until the time, t−Δt. In FIG. 4, the temperature set-point equals the idle temperature. In other embodiments, the idle temperature is either above or below the temperature set-point. At the time t−Δt, open-loop control is initiated to increase the power output of the heating element of the fuser roll or fuser belt, to increase the temperature of the fusing imaging surface, as shown. The fusing imaging surface reaches a maximum temperature, $T_{MAX}$, at about the time t. The target value of $T_{MAX}$ can be predetermined or estimated using simulations and empirical testing. For a given media type, e.g., lightweight paper, increasing the time delay increases the amount of power supplied to the heating element, which may or may not increase the maximum temperature, $T_{MAX}$, reached by the fusing imaging surface.

At time t, the medium contacts the fusing imaging surface and causes its temperature to drop progressively to a minimum temperature, $T_{MIN}$, which is below $T_{SET}$. The drop in temperature to below the desired temperature, i.e., the temperature set-point, is referred to as "droop." Feedback control is resumed at time t to cause the fusing imaging surface temperature to increase from $T_{MIN}$ to about the temperature set-point, $T_{SET}$.

In embodiments, it is desirable to minimize the maximum temperature, $T_{MAX}$, to which the fusing imaging surface is heated by the open-loop control. Minimizing $T_{MAX}$ can avoid exposing toner particles carried on media to an overly-high temperature and, as a result, producing certain related failure modes with image quality. Minimizing $T_{MAX}$ can also prolong the life of the fuser roll or fuser belt.

In embodiments, it is also desirable to minimize the area, $I_{OS}$, defined between the temperature versus time curve above $T_{SET}$ (related to temperature overshoot), and also to minimize the area, $I_D$, defined between the temperature versus time curve below $T_{SET}$, related to droop in the temperature of the fuser roll or fuser belt. In embodiments, the time delay Δt is estimated by the following equation (1):

$$\Delta t = A \cdot I_D - B \cdot I_{OS} \tag{1}$$

In equation (1), A and B are weighing constants. When $I_D$□□$I_{OS}$, Δt is increased, and when $I_{OS}$□□$I_D$, Δt is decreased. In embodiments, it is desirable to balance the weighing constants A and B to constrain $I_{OS}$ (and also $T_{MAX}$ and $T_{MIN}$) from becoming undesirably high. It is also desirable to optimize the time delay and minimize the areas $I_D$ and $I_{OS}$.

In embodiments, the time delay, Δt, is used to address the thermal transient that occurs at the transition from the idle state to the run state of the printing apparatus. In the idle state, the heating element of the fuser roll, or heating elements of multiple rolls supporting the fuser belt, operate at a low power level (e.g., about 5% to about 10% of the maximum rated power). By heating the fuser roll or fuser belt at a high power level (e.g., up to 90% of the maximum power level, or even at full power, of the heating element) during the time delay period, initial media of print job are not subjected to a low temperature at the nip, and the feedback controller is able to resume control of heating the fuser roll or fuser belt once the run state of the fuser has been initiated. In embodiments, the heating element (e.g., lamp) signal is pulse width modulated (PWM), so that the heating elements are either on or off. The power level is controlled by the duty cycle of the PWM input.

In embodiments, the value of the time delay, Δt, used for the first medium of a print job heated by the fuser roll or fuser belt, when transitioning from the idle state to the run state, can be predetermined based on empirical testing, or by simulation of the printing apparatus. Using the stored time delay value, one or more media of the print job (e.g., from one to at least ten media) can be analyzed (e.g., visually inspected) to determine the toner image quality on the media, which reflects fuser droop performance. If the toner image quality is determined to not meet desired image criteria (e.g., toner adherence to the media is unsatisfactory), indicating that a temperature droop larger than a desirable maximum value occurred for the time delay, then the time delay for that media type can be recalculated using Equation (1) with the time delay calculator. In embodiments, the temperature performance of the fuser roll or fuser belt can be evaluated based on a temperature versus time curve (such as shown in FIG. 4), indicating temperature overshoot and droop performance. Temperature performance data is provided to the time delay calculator from one or more temperature sensors operatively associated with the fuser roll or fuser belt. The recalculated value of the time delay sent to the open-loop controller can be larger or smaller than the initial value. When additional sheets to those included in a print job are needed to characterize the thermal transient, the calculation of the new value of the time delay can be aborted for the print job and additional sheets can be run until the thermal transient is sufficiently characterized.

In embodiments, initial and recalculated values of time delays for different media types can be stored in a table located, e.g., in machine non-volatile memory. When time delay values are recalculated, the table can be automatically updated to include the recalculated values. Subsequently, the recalculated time delay values are used for subsequent print jobs for the corresponding media types included in the table.

In embodiments, open-loop control of the heating element of the fuser roll, or heating elements of rolls supporting the fuser belt, and the corresponding time delay are only used when the printing apparatus transitions from the idle state to the run state, to address the problem of unsatisfactory toner image quality on initial media of print jobs. Changing the media type when the printing apparatus is in the run state is less of a disturbance with respect to thermal fluctuations of the fuser roll or fuser belt than the change from the idle state to the run state. For this reason, the changing of the media type is typically not considered in the algorithm for controlling the open-loop control. For example, the idle state to run state transient can use from about 10% of the heating element power rating in the idle state to about 90% of the power rating in the run state, during which transition the desired heat flux for the fuser roll or fuser belt is established. The heat flux can typically be established significantly faster when transitioning from a power rating of 90% to 70% (e.g., when going from thicker to thinner media in successive print jobs), or when transitioning from a power rating of 70% to 90% (e.g., when going from thinner to thicker media in the printing apparatus), that when transitioning from the idle state to run state.

EXAMPLES

An example of operating a fuser having a configuration as shown in FIG. 2 to fuse toner on media is modeled. TABLE 1 shows seven different media types: uncoated lightweight, uncoated mid-weight, uncoated heavyweight, coated lightweight, coated mid-weight, coated heavyweight and transparency, media nos. 1 to 7, respectively. As shown, these different media types have different corresponding time delays, Δt1 to Δt7, which have numerical values that increase in this order. In the model, lightweight media nos. 1 and 4 have a fusing temperature of 180° C., mid-weight media nos. 2 and 5 have a fusing temperature of 190° C., heavyweight media nos. 3 and 6 have a fusing temperature of 200° C., and the transparency, media no. 7, has a fusing temperature of 200° C.

TABLE 1

| Media No. | Media Type | Time Delay |
|---|---|---|
| 1 | Uncoated Lightweight | Δt1 |
| 2 | Uncoated Mid-Weight | Δt2 |
| 3 | Uncoated Heavyweight | Δt3 |
| 4 | Coated Lightweight | Δt4 |
| 5 | Coated Mid-Weight | Δt5 |
| 6 | Coated Heavyweight | Δt6 |
| 7 | Transparency | Δt7 |

In the model, each time that a print job starts from the idle state with a specific media, an algorithm uses the time delay value specified in TABLE 1 for that media type, for open-loop control of the heating element of the fuser roll. In the model, lightweight media nos. 1 and 4 have time delays Δt1 and Δt4 of 5 seconds and 7 seconds, respectively; mid-weight media nos. 2 and 5 have time delays Δt2 and Δt5 of 10 seconds and 12 seconds, respectively; heavyweight media nos. 3 and 6 have time delays Δt3 and Δt6 of 15 seconds and 17 seconds, respectively; and the transparency, media no. 7, has a time delay of 17 seconds. The printing performance for the media is then measured and the initial time delay value is updated after the job starts.

In the model, the following machine configuration is used: line voltage of 208 V, heating element (lamp) rating of 1000 W, no current-limiting devices used, and fuser roll type A.

The printing apparatus starts in the idle state. The following Job No. 1 is submitted: run 10 sheets of coated lightweight media (Media No. 4). The printing apparatus cycles up and enters the run state. The printing apparatus powers the heating element in the fuser roll to full power using open-loop control prior to the sheets arriving at the fuser roll using delay time Δt4.

The fuser droop performance is measured as the first medium of print Job No. 1 is printed. If the temperature does not return to the set point before the job is finished, the measurement of the area of the droop portion of the graph is not used, and the calculation and update of the time delay for Media No. 4 is aborted. When the thermal transient has been characterized, a new value of the time delay for Media No. 4, Δt4-1, is calculated using a time delay calculator and then stored in TABLE 2. The new value of the time delay, Δt4-1 is calculated using the areas $I_{OS}$ and $I_D$ from the fuser temperature versus time curve, using Equation (1). If the time delay, Δt4-1, is already at an optimum value, it is still calculated and written to TABLE 2.

TABLE 2

| Media No. | Media Type | Time Delay |
|---|---|---|
| 1 | Uncoated Lightweight | Δt1 |
| 2 | Uncoated Mid-Weight | Δt2 |
| 3 | Uncoated Heavyweight | Δt3 |
| 4 | Coated Lightweight | Δt4 − 1 |
| 5 | Coated Mid-Weight | Δt5 |
| 6 | Coated Heavyweight | Δt6 |
| 7 | Transparency | Δt7 |

The printing apparatus then cycles out and returns to the idle state.

A user then submits the following Jobs 2 and 3: Job 2: run 10 sheets of coated lightweight media (Media No. 4), and Job 3: run 100 sheets of uncoated mid-weight media (Media No. 2). Job 2 is to be run before Job 3.

The printing apparatus cycles up and enters the run state. The algorithm initiates open-loop control to power the heating element in the fuser roll to full power using the time delay Δt4-1 stored in TABLE 2, as Media No. 4 is the media type used at the start of Job 2.

The fuser droop performance is measured as the first medium of print Job No. 2 is printed. In the model, when more than 10 sheets are needed to characterize the thermal transient, the calculation of the new value of the time delay for Media No. 4 is aborted for this job. When the thermal transient has been characterized, a new value of the time delay for Media No. 4, Δt4-2, is calculated and then stored in TABLE 3. The new time delay, Δt4-2, is calculated using the areas $I_{OS}$ and $I_D$ from the fuser temperature versus time curve, using Equation (1).

TABLE 3

| Media No. | Media Type | Time Delay |
|---|---|---|
| 1 | Uncoated Lightweight | Δt1 |
| 2 | Uncoated Mid-Weight | Δt2 |
| 3 | Uncoated Heavyweight | Δt3 |
| 4 | Coated Lightweight | Δt4 − 2 |
| 5 | Coated Mid-Weight | Δt5 |
| 6 | Coated Heavyweight | Δt6 |
| 7 | Transparency | Δt7 |

The printing apparatus cycles out and returns to the idle state.

Job No. 3 is then run. Job No. 3 starts when the printing apparatus is already in a run state, and so a time delay is not used for the printing apparatus when changing from Media No. 4 to Media No. 2.

Next, a user submits Job 4: run 1000 sheets of uncoated mid-weight media (Media No. 2). The printing apparatus cycles up and enters the run state. The algorithm initiates open-loop control to power the heating element in the fuser roll to full power using the time delay Δt2 stored in TABLE 3.

The fuser droop performance is measured as the first medium of print Job No. 4 is printed. When the thermal transient has been characterized, a new value of the time delay for Media No. 2, Δt2-1, is calculated and then stored in TABLE 4.

The printing apparatus cycles out and returns to the idle state.

TABLE 4

| Media No. | Media Type | Time Delay (Δt) |
|---|---|---|
| 1 | Uncoated Lightweight | Δt1 |
| 2 | Uncoated Mid-Weight | Δt2 − 1 |
| 3 | Uncoated Heavyweight | Δt3 |
| 4 | Coated Lightweight | Δt4 − 2 |
| 5 | Coated Mid-Weight | Δt5 |
| 6 | Coated Heavyweight | Δt6 |
| 7 | Transparency | Δt7 |

It will be appreciated that various ones of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, which are also intended to be encompassed by the following claims.

What is claimed is:

1. A fuser, comprising:

a fuser roll comprising a fusing imaging surface;

at least one heating element for heating the fuser roll;

a pressure roll including an outer surface, the outer surface and the fusing imaging surface defining a nip;

a temperature sensor for sensing a temperature on the fusing imaging surface;

a time delay calculator connected to the temperature sensor;

a feedback controller connected to the temperature sensor and the heating element, the feedback controller receives a signal from the temperature sensor indicating the temperature on the fusing imaging surface and controls the heating element based on the temperature; and an open-loop controller connected to the heating element and the time delay calculator;

wherein the open-loop controller receives a time delay signal from the time delay calculator and bypasses the feedback controller to control the heating element to increase the temperature of the fusing imaging surface starting at about a time, t−Δt (where Δt is a time delay), which is before a medium arrives at the nip, and continuing until about a time, t, at which the medium arrives at the nip and is contacted by the fusing imaging surface, and the feedback controller resumes control of the heating element at about the time t.

2. The fuser of claim 1, further comprising a summing junction at which input signals from the feedback controller and the open-loop controller are added to produce an output signal to the heating element.

3. The fuser of claim 1, further comprising a sensor connected to the time delay calculator and the open-loop controller for sensing the arrival time, t, of the medium at the nip.

4. A printing apparatus, comprising:

a fuser according to claim 1; and a sheet feeding device for feeding the medium, which has toner thereon, to the nip at which the fusing imaging surface and the outer surface apply heat and pressure to the medium to fuse the toner on the medium.

5. A fuser, comprising:

a fuser belt having a fusing imaging surface;

a first heating element for heating the fuser belt;

a temperature sensor for sensing a temperature on the fusing imaging surface;

a pressure roll including an outer surface, the outer surface and the fusing imaging surface defining a nip;

a time delay calculator connected to the temperature sensor;

a feedback controller connected to the temperature sensor and the first heating element, the feedback controller receives a signal from the temperature sensor indicating the temperature on the fusing imaging surface and controls the first heating element based on the temperature; and an open-loop controller connected to the first heating element and the time delay calculator;

wherein the open-loop controller receives a time delay signal from the time delay calculator and bypasses the feedback controller to control the first heating element to increase the temperature of the fusing imaging surface starting at about a time, t−Δt (where Δt is a time delay), which is before a medium arrives at the nip, and continuing until about a time, t, at which the medium arrives at the nip and is contacted by the fusing imaging surface, and the feedback controller resumes control of the first heating element at about the time t.

6. The fuser of claim 5, further comprising:

a fuser roll supporting the fuser belt, the first heating element being located inside of the fuser roll;

an idler roll supporting the fuser roll; and a second heating element located inside of the idler roll;

wherein the feedback controller and open-loop controller are connected to the second heating element; and wherein the open-loop controller bypasses the feedback controller to control the second heating element to increase the temperature of the fusing imaging surface starting at about the time, t−Δt, and continuing until about the time, t, and the feedback controller resumes control of the second heating element at about the time t.

7. The fuser of claim 6, further comprising a summing junction at which input signals from the feedback controller and open-loop controller are added to produce output signals to the first and second heating elements.

8. The fuser of claim 5, further comprising a summing junction at which input signals from the feedback controller and open-loop controller are added to produce an output signal to the first heating element.

9. The fuser of claim 5, further comprising a sensor connected to the time delay calculator and the open-loop controller for sensing the arrival time of the medium at the nip.

10. A printing apparatus, comprising:

a fuser according to claim 5; and a sheet feeding device for feeding the medium, which has toner thereon, to the nip at which the fusing imaging surface and the outer surface apply heat and pressure to the medium to fuse the toner on the medium.

11. A method of fusing toner on a medium in a fuser comprising a fusing member including a fusing imaging surface, at least a first heating element for heating the fusing imaging surface, a feedback controller and an open-loop controller connected to the first heating element, a time delay calculator connected to the feedback controller, a pressure roll including an outer surface, and a nip defined between the fusing imaging surface and the outer surface, the method comprising:

sensing a temperature on the fusing imaging surface;

controlling the first heating element with the feedback controller based on the temperature on the fusing imaging surface;

feeding a first medium having toner thereon toward the nip;

sending a time delay signal from the time delay calculator to the bypass controller to bypass the feedback controller using the open-loop controller to control the first heating element to increase the temperature of the fusing imaging surface starting at about a time, t1−Δt1 (where Δt1 is a time delay), which is before the first medium arrives at the nip, and continuing until about a time, t1, at which the first medium arrives at the nip and is contacted by the fusing imaging surface; and resuming control of the first heating element by the feedback controller at about the time t1.

12. The method of claim 11, wherein the fusing member is a fuser roll and the first heating element is disposed inside of the fuser roll.

13. The method of claim 11, wherein the fusing member is a fuser belt and the first heating element is located inside of a fuser roll supporting the fuser belt.

14. The method of claim 13, wherein:

the fuser further comprises an idler roll supporting the fuser belt and a second heating element located inside of the idler roll; and the method further comprises:

bypassing the feedback controller using the open-loop controller to control the second heating element to increase the temperature of the fusing imaging surface starting at about the time, t1−Δt1, and continuing until about the time, t1; and resuming control of the second heating element by the feedback controller at about the time t1.

15. The method of claim 11, further comprising adding input signals from the feedback controller and the open-loop controller at a summing junction to produce an output signal to the first heating element.

16. The method of claim 11, further comprising:

assigning the time delay Δt1 to the first medium based on characteristics of the first medium;

sensing the arrival of the first medium at the nip using a sensor connected to the time delay calculator and the open-loop controller;

determining the time t1 based on the sensed arrival of the first medium at the nip; and determining the time t1−Δt1.

17. The method of claim 16, wherein the characteristics include the weight of the first medium.

18. The method of claim 11, further comprising:

assigning the time delay Δt1 to the first medium based on characteristics of the first medium;

analyzing a toner image fused on the first medium using Δt1; and when, the toner image is determined to not meet image criteria:

calculating a time delay Δt1-1, which is different from Δt1, using the time delay calculator;

sensing the temperature on the fusing imaging surface;

controlling the first heating element with the feedback controller based on the temperature on the fusing imaging surface;

feeding a second medium having toner thereon toward the nip, the second medium having the same characteristics as the first medium;

sensing the arrival of the second medium at the nip using a sensor connected to the time delay calculator and the open-loop controller;

sending a time delay signal from the time delay calculator to the feedback controller to bypass the feedback controller using the open-loop controller to control the first heating element to increase the temperature of the fusing imaging surface starting at about a time, t2−Δt1-1, which is before the second medium arrives at the nip, and continuing until about a time, t2, at which the second medium arrives at the nip and is contacted by the fusing imaging surface; and resuming control of the first heating element by the feedback controller at about the time t2.

19. The method of claim 11, further comprising:

assigning the time delay Δt1 to the first medium based on characteristics of the first medium;

analyzing a toner image fused on the first medium using Δt1; and when, the toner image is determined to meet image criteria:

sensing the temperature on the fusing imaging surface;

controlling the first heating element with the feedback controller based on the temperature on the fusing imaging surface;

feeding a second medium having toner thereon toward the nip, the second medium having characteristics that are the same as, or different from, those of the first medium;

sensing the arrival of the second medium at the nip using a sensor connected to the time delay calculator and the open-loop controller;

sending a time delay signal from the time delay calculator to the feedback controller to bypass the feedback controller using the open-loop controller to control the first heating element to increase the temperature of the fusing imaging surface starting at about the time, t2−Δt1, which is before the second medium arrives at the nip, and continuing until about a time, t2, at which the second medium arrives at the nip and is contacted by the fusing imaging surface; and resuming control of the first heating element by the feedback controller at about the time t2.

20. The method of claim 19, wherein the second medium has different characteristics than the first medium.

* * * * *